United States Patent [19]

Kerns et al.

[11] 4,438,367

[45] Mar. 20, 1984

[54] HIGH POWER RADIO FREQUENCY ATTENUATION DEVICE

[75] Inventors: Quentin A. Kerns, Bloomingdale; Harold W. Miller, Winfield, both of Ill.

[73] Assignee: The United States of America as represented by the United States Department of Energy, Washington, D.C.

[21] Appl. No.: 335,996

[22] Filed: Dec. 30, 1981

[51] Int. Cl.[3] ..... H01J 25/10

[52] U.S. Cl. ..... 315/5.41; 313/20; 315/5.42; 333/81 R; 328/233

[58] Field of Search ..... 313/20, 21, 39; 333/81 R, 81 B; 315/5.41, 5.42; 328/233

[56] References Cited

U.S. PATENT DOCUMENTS

| | | | |
|---|---|---|---|
| 2,853,687 | 9/1958 | Weber | 333/81 B |
| 2,877,410 | 3/1959 | Robbins | 333/81 B |
| 2,922,964 | 1/1960 | Turner | 333/81 B |
| 2,958,055 | 10/1960 | Rowen | 333/81 B |
| 3,133,227 | 5/1964 | Brown et al. | 315/5.42 |
| 3,264,515 | 8/1966 | Haimson | 333/81 X |
| 3,358,181 | 12/1967 | Zitelli et al. | 313/20 X |
| 3,394,282 | 7/1968 | Schmidt | 315/5.38 X |
| 3,449,618 | 6/1969 | Gallagher | 315/5.41 |
| 3,806,841 | 4/1974 | Brunner | 333/81 R |

*Primary Examiner*—Saxfield Chatmon, Jr.

*Attorney, Agent, or Firm*—Paul A. Gottlieb; Bruce R. Mansfield; Michael F. Esposito

[57] ABSTRACT

A resistor device for attenuating radio frequency power includes a radio frequency conductor connected to a series of fins formed of high relative magnetic permeability material. The fins are dimensional to accommodate the skin depth of the current conduction therethrough, as well as an inner heat conducting portion where current does not travel. Thermal connections for air or water cooling are provided for the inner heat conducting portions of each fin. Also disclosed is a resistor device to selectively alternate unwanted radio frequency energy in a resonant cavity.

5 Claims, 6 Drawing Figures

FIG 3
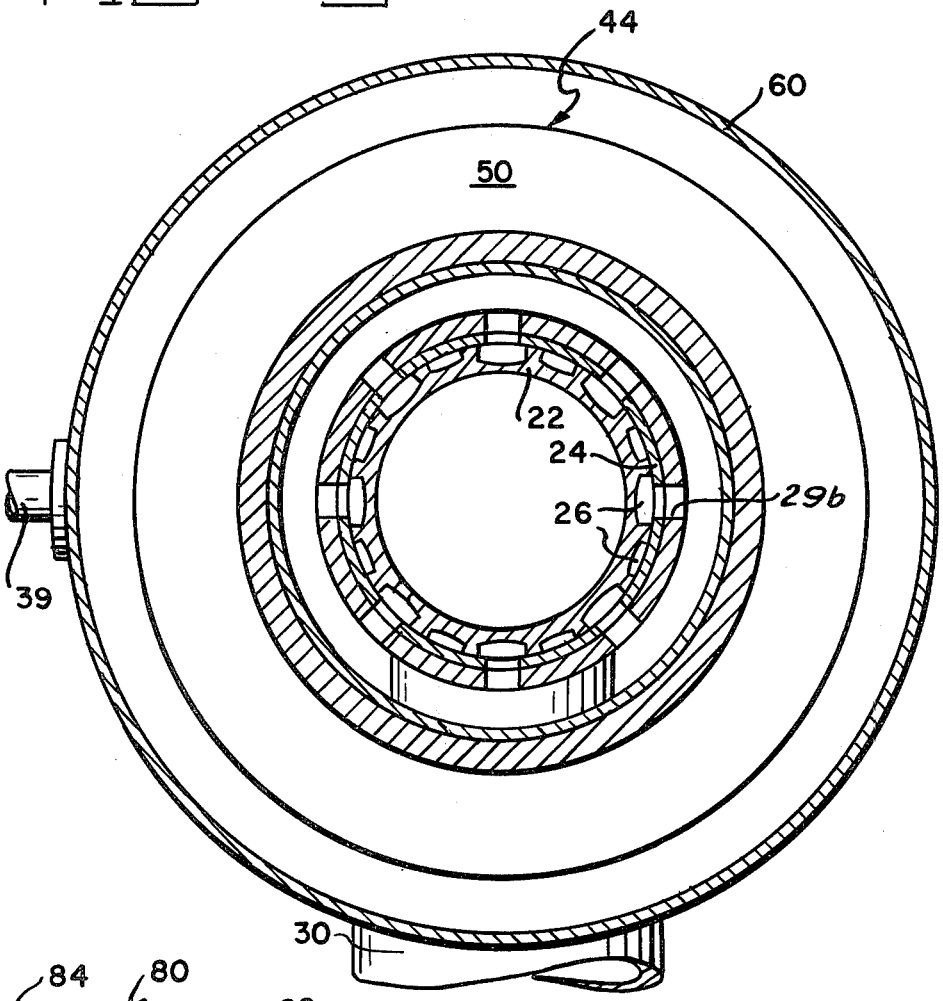
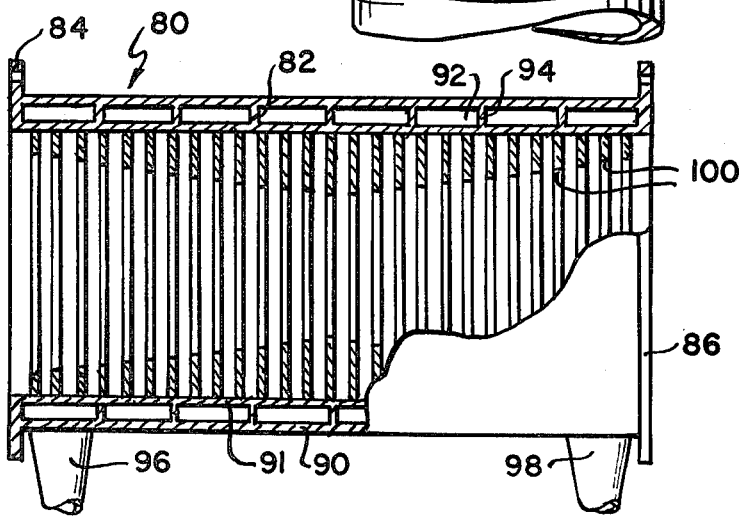
FIG 6

HIGH POWER RADIO FREQUENCY ATTENUATION DEVICE

CONTRACTURAL ORIGIN OF THE INVENTION

The United States Government has rights in this invention pursuant to Contract No. EY-76-C-02-3000 between the U.S. Department of Energy and Fermi National Accelerator Laboratory.

BACKGROUND OF THE INVENTION

The need often arises in radio frequency devices to have an electrical resistor which can attenuate radio frequency energy. Typically, such devices are designed to operate at a given resonant frequency, but other frequencies are often found present in the device also. These other frequencies are unwanted because they interfere with frequency dependent receivers of the RF power or because the useful RF power of the device is reduced. Various arrangements have been proposed to identify and discriminate against unwanted frequencies, as by absorbing or attenuating the identified unwanted frequencies.

High frequency attenuators or loads fall into two groups which differ in the means by which the power is attenuated. The first group utilizes a waveguide operated at a frequency which is below the characteristic cut-off frequency as by the size and shape of the waveguide. The electromagnetic fields excited at one end of the waveguide couple weakly to a receiving element at the other end of the waveguide, the amount of coupling depending on the length and size of the waveguide. This technique is particularly suitable for application in the microwave region, although it has been employed at frequencies as low as a few megacycles per second. One of the most common microwave attenuators of this type is one which utilizes a waveguide beyond cutoff. It is well known that for a given frequency of oscillation, one can reduce the dimensions of either circular or rectangular waveguides to a point where energy of this frequency can no longer be propagated in the waveguide. Below the cutoff frequency, the fields decay exponentially along the waveguide, and the phases change a negligible amount by losses in the walls. It is possible to excite fields in a waveguide beyond cutoff in several ways, and to couple selectively to a mode of transmission whose attenuating characteristics can be calculated.

In a second group of attenuators, radio frequency power is absorbed in poorly conducting materials and transformed into heat, as in conventional resistors which are used at very low frequencies. For laboratory use, many RF attenuators of this type are available which give fixed or variable attenuation of the main power flow, or which permit power sampling for power-monitoring purposes, without reacting perceptably upon the main power flow. For low power ranges, it is usually permissible to insert in the main power path devices having a dielectric base upon which thin coatings of power-absorbing materials such as carbon or Aquadag are applied. One design utilizes a thermosetting plastic, which is cast in a section of the line to be terminated. The plastic material, Durez 7421, is relatively easy material to machine, and a conical matching taper of the correct length can be cut on a lathe. A second type of load or attenuator has been made from a resistive cloth, Uskon. A long trapezoidal piece of the cloth is tightly wrapped around the inner conductor of the coaxial line in such a way that a conical matching taper, followed by a completely filled length of line is formed. This is a less durable load than the one made from Durez, particularly since the cloth has a tendency to fray at the tip of the taper, thereby producing reflections. Loads of this type may be made for a variety of sizes of coaxial lines, but may become objectionably long at wavelengths longer than microwaves. Various polyiron materials have been used effectively in making step terminations in coaxial lines. Stepped cylinders of the polyiron material have been used to form terminations in coaxial lines operated at wavelengths considerably longer than microwaves. This material has the disadvantage, however, in that its high frequency properties vary considerably from batch to batch, and the dimensions often need to be corrected when units are made from a new batch. Also, polyiron is not an easy material to machine. Diamond-dust grinders and Carboloy-tipped drill bits and lathe tools must be used in cutting and otherwise machining the material. Further, a health hazard is presented to the machinist in the form of iron dust formed during the machining operations.

Other low-power terminations include metalized glass arrangements. In one such device, a thin evaporated Nichrome film is sandwiched between a glass plate support and a thin protective magnesium fluoride film. However, the film material is prohibitively expensive and problems are encountered in providing a glass plate of sufficient mechanical strength. Further, such attenuators have to be made objectionably long in order to provide sufficient attenuation to effectively eliminate reflections from the short circuit of a mechanical holder supporting the device. These longer lengths aggravate the stress in the relatively fragile glass plate. Other uses of metalized-glass dissipative elements in waveguide transmission systems include glass plates which carry a metal film only on one side and which are suspended in the waveguide with the film parallel to the electric field lines. In the simplest construction, the glass plate has one or two holes drilled along its centerline and is cemented to one or two metal struts. The struts penetrate the guide wall, preferably at right angles to the electric field lines. The struts can, in turn, be made to move and carry the glass plate across the waveguide, as in the variable waveguide attenuators. Instead of drilling holes, these attenuators may be formed by employing a fine gas flame to burn out or melt the holes. In either event, specially formed eyelets of German-solder material or the like are crimped onto the glass by special equipment and the struts are soldered to the eyelets.

For larger powers, in order to provide for efficient heat transfer to the ambient air, power-absorbing materials in greater bulk and with proper metal casings are inserted in the RF conductor. One example of a high-power attenuator is a sand load comprising Aquadag-coated sand as a dissipative medium. A 50—50 mixture of coated and uncoated sand is used as a filling material for the load. A metal end plug is soldered in place to terminate the line. Loads of this type dissipate lower levels of energy and are difficult to reproduce, resulting in a high reject percentage, even for lenient maximum voltage standing wave ratio specifications. Further, the sand loads of this type suffer because they do not make use of stepped or continuous tapers at their input ends. Steps or a smooth taper facilitate impedance-matching and tend to allow a more uniform power dissipation along its length. Other large power attenuators include a coaxial-line load which makes use of a straight conical taper to the outer conductor. The load material first used with this design was polyiron made resistant to high temperatures by a ceramic binder. However, it was impossible to mold a taper lip properly and matching of such a taper into polyiron was objectionably difficult in commercial production. The search for other more suitable materials resulted in mixtures of graphite and cement.

In the microwave region, more work has been done in high-power waveguide loads than on coaxial loads since the waveguide has a greater pulse power capacity than the coaxial line, and since the skin loss in the metal walls of the line is smaller in waveguides than in coaxial lines. Sand loads made of the same composition as described above have been held in a tapered position by a Transite plate. The power limitation of loads of this type results because of the inability of the Transite material to withstand high temperatures. The waveguide tapered sand loads offer an advantage in that they have more reproducable and accurate characteristics than do the coaxial sand loads, but all of them suffer from varying impedance as the moisture absorption of the sand changes. Moreover, their construction permits shock and vibration to break and structure containing the sand, or even to change the match of the load because of a change in the compactness of the sand. Other methods of construction waveguide high-pwwer loads include using waveguide walls which are poor conductors, instead of using attenuating material which completely fills the waveguide. The dissipative material frequently used in such arrangements comprises a mixture of 35% Portland cement and 65% Dixon's No. 2 powdered flaked graphite. However, such loads require sand-graphite mixtures of precise proportions and a crumbly unworkable material results if the graphite percentage is too high, while too little graphite makes the attenuation constant too high. Further, such constructions suffer from poor heat dissipation qualities and also because if the dissipative plug fails to fit the guide well, so as to form intimate contact therewith, sparking between the walls of the guide and particles in the dielectric may ensure.

Many microwave applications include evacuated waveguide constructions. Even if the graphite content is reduced to avoid a crumbly composition, the mixture absorbs gas and moisture, rendering it unsuitable for a vacuum environment.

Coaxial loads in use today are of two types: a very bulky air-cooled arrangement or a more compact water cooled metallized glass arrangement. In the latter construction, a ceramic tubular substrate is coated with a thin film dissipative metal material. The ends of the metallized tube are painted with a conductive material to form a contact ring. Power is applied to the rings through spring loaded contact fingers which are maintained in pressure contact with the rings. Cooling water is circulated over the outer surface of the metal material in an axial direction. Locally high water flow velocities are developed in the small area where the spring finger contacts the connector ring, causing erosion of the finger and ring material and occasional separation of the finger from the ring. This induces arcing and further erosion in the contact area between the finger and the ring.

A particular problem has arisen in high vacuum, high power radio frequency cavities having several standing waves present during operation. It is frequently desired to identify and isolate unwanted out-of-phase modes, preventing their interference with desired in-phase standing wave modes. In addition to being able to withstand high continuous power dissipation and thermal cycling stresses, resistors installed in such cavities must be formed of materials which do not outgas or otherwise destroy the vacuum established in the cavity. Further difficulties are encountered in providing RF resistors for retrofit application to existing RF devices, in that space within and surrounding such equipment has been previously utilized according to the original design of the equipment.

It is therefore an object of the present invention to provide a high-power radio frequency resistor which exhibits a uniform power dissipation along its length, while incorporating high thermal efficiency heat removal means.

An additional object of the present invention is to provide a radio-frequency resistor which has accurate reproducible attenuation and load matching characteristics not affected by temperature, moisture, vibration, or thermal shock.

Also, it is an object of the present invention to provide a radio-frequency resistor of the type described above which is compact, mechanically rugged, and easy to fabricate without requiring costly equipment.

Another object of the present invention is to provide an RF resistor for a hard vacuum high temperature environment which selectively damps unwanted out-of-phase energy in a resonant RF cavity.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other objects of the present invention are provided by a high power RF resistor comprising a set of spaced-apart plates disposed about a copper tube. The plates are formed of a high relative magnetic permeability metal alloy. The copper tube is connected to an RF circuit such that the RF current flows over the surfaces of the copper tube and the plates. For a given RF current and metal alloy composition, a skin depth is established on opposing surfaces of each plate. The plates have a thickness substantially greater than twice the skin depth, with the inner bulk material of the plate providing a thermal conductive path to the copper tube, the inner surface of which is water cooled. One example of the invention incorporates the RF resistor in a resonant cavity of a particle accelerator. The resistor is comprised of two spaced-apart sets of plates mounted on a common copper tube. Spaced-apart copper shields surrounding each set of plates are attached to the copper tube. The copper shields transmit applied RF power to the copper tube, and shield the sets of plates from desired in-phase standing waves. The gap between resistor plate sets is located at the current maxima of unwanted out-of-phase standing waves to selectively damp those waves. The sets of plates provide a long RF path of decreased skin depth, effectively dissipating 500 watts of RF power in a 5 ohm resistance load.

DESCRIPTION OF THE DRAWINGS

FIG. 3 is a cross-sectional view of the RF resistor taken along the lines 3—3 of FIG. 2.

FIG. 6 is a cross-sectional plan view taken along the lines 6—6 of FIG. 4.

DETAILED DESCRIPTION OF THE PREFERRED EMBODIMENT

Figure 1:
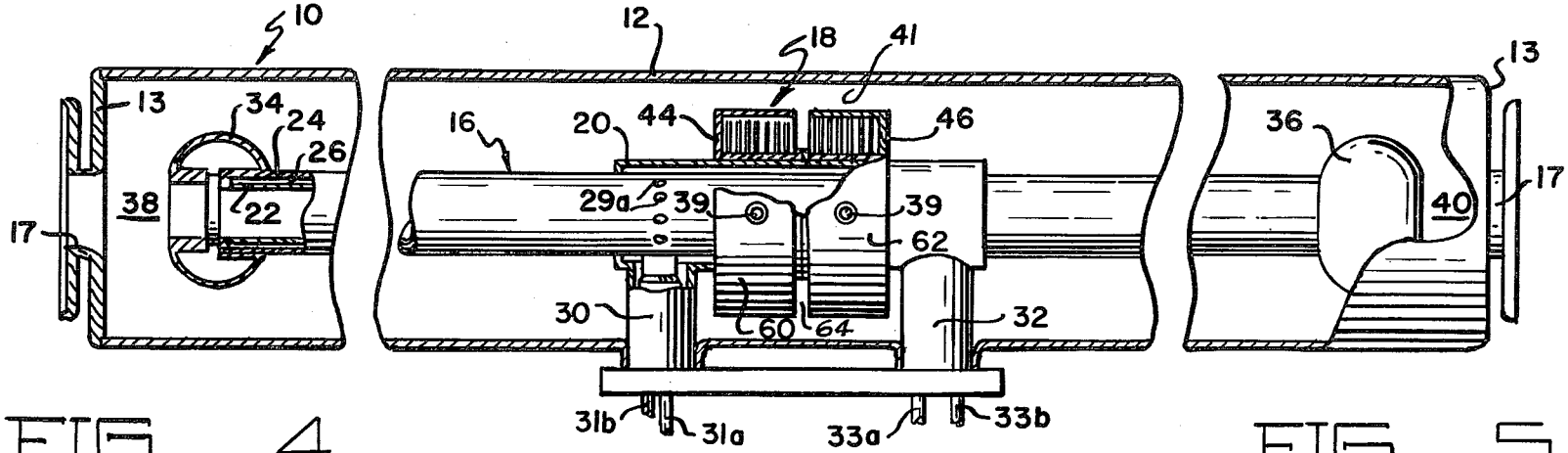
FIG. 1 is an elevational view of a resonant cavity including an RF resistor according to the invention.

The high power radio frequency resistor of the invention will first be described with respect to a particular application in a particle accelerator. The resistor, however, finds broader applications wherever high power radio frequency energy must be absorbed, as will be explained later.

The radio-frequency resistor of the invention has been designed for use in the Fermi National Accelerator Laboratory Superconducting Particle Accelerator. The beam to be accelerated in that device consists of a series of pulses, or beam bunches, of protons. The pulses are about 3 nanoseconds wide, and the pulse repetition rate is about 53 MHZ, the radio frequency of the accelerator. After formation in a beam buncher, the pulsed beam is accelerated in a radio frequency (RF) accelerating resonator, the device for which the RF resistor of this invention was designed. The resonator is a high energy (1.1 Joules stored energy) high power (52 KW dissipation power) device. Due to space limitations, the resonator had to be located directly under the Main Ring components of the accelerator, in a space having a vertical clearance of $15^3/16$ inches. Referring now to the drawings and especially to FIG. 1, a fixed frequency RF accelerating resonator 10 is shown comprising an elongated vacuum enclosure or a copper tank 12, which is connected at its end walls 13 to an accelerator ring not shown in the drawings. A passageway of proton bunches through tank 12 is provided by copper drift tube 16 which is mounted for coaxial alignment within tank 12. Openings 17 in end walls 13 and copper drift tube 16 form a path for a beam to be accelerated.

Figure 2:
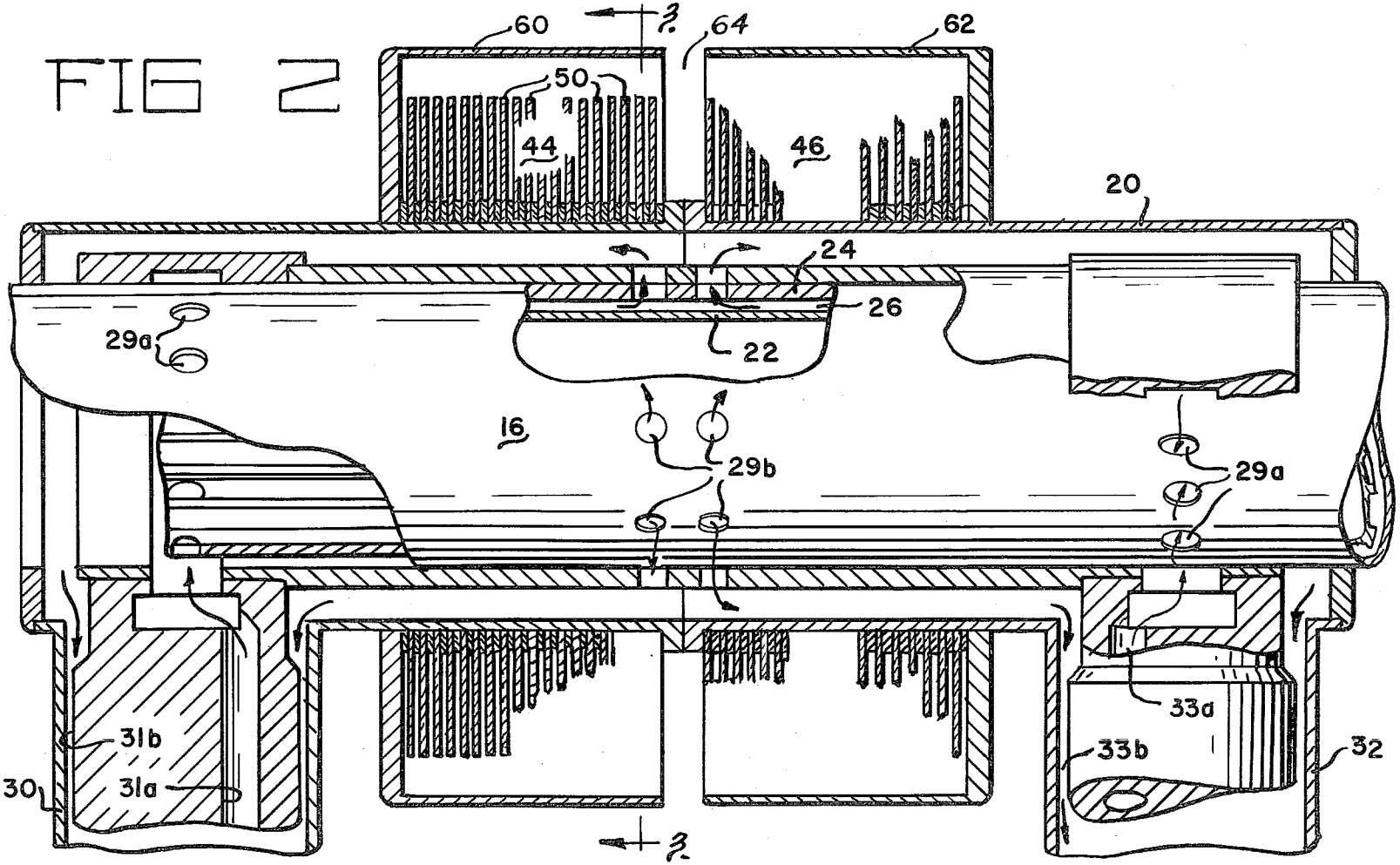
FIG. 2 is an elevational view of the RF resistor of FIG. 1, shown in greater detail.

Referring now to FIGS. 1 and 2, resistor assembly 18 provides electrical energization and mechanical support for drift tube 16. Resistor assembly 18 comprises a tubular collar 20 of OFHC copper. Drift tube 16, coaxially aligned with collar 20 and tank 12, consists of two concentric cylinders 22, 24 welded at each end and separated by an arrangement of water channels 26. Alternating channels 26 comprise supply and return paths respectively for coolant flow circulated within drift tube 16, and resistor assembly 18. Manifolds are provided at the outer ends of drift tube 16 to interconnect pairs of adjacent supply/return channels. Every other channel 26 has a "soda straw" wall arrangement of five turns of 0.0015 inch diameter stainless wire rolled together for slidable insertion into the cooling channels. The "soda straw" wall arrangements, installed in the return channels, minimize the counter flow heat exchange between adjacent supply and return water channels. Connections between channels 26 and an external coolant temperature control system (not shown in the drawings) are made by three inch diameter OFHC copper cylinders or stems 30,32. Stems 30,32 are connected to mirror image halves to drift tube 16, each of which comprises one independent cooling subsystem. Each stem contains two water conduits 31 connected to orifices 29 which are formed in outer cylinder 24 so as to provide communication with channels 26. For example, conduit **31*a* is connected to inlet orifice 29*a* to supply coolant to a supply channel 26. Coolant flows toward the outer free end of drift tube 16 and returns via an adjacent channel 26 to outlet orifice 29*b* and return conduit 31*b*. This cooling arrangement, in conjunction with the external coolant control system thermally adjusts the lengths of drift tube 16 and tank 12, so as to provide fine tuning of the operating frequency of resonator 10**, independent of RF power levels.

Resonator 10 is excited with a standing wave one-half wavelength long. Excitation of the standing wave within resonator 10 is accomplished by applying RF power to the center of resistor 20 at connection points 39. A $9^3/16$ inch diameter coax line whose outline is indicated by dashed line 41, is bifurcated for connection to each pont 39. Because there is only a small frequency range required for the accelerator system, resonator 10 is a fixed-tuned structure. High voltage connection to each half of drift tube 16 is made through stems 30,32. This connection is used to set up a voltage gradient between drift tube 16 and the end walls 13 of tank 12.

Referring again to FIG. 1, the ends of drift tube 16 are capped by electro-polished corona rolls 34, 36. Upstream and downstream gaps 38, 40 respectively, formed between corona rolls 34, 36 and the end walls 13 of drift tube 16 and tank 12, are each designed to accelerate the beam bunches that pass through resonator 10. The accelerator gaps are spaced apart the length of drift tube 16, and are phased $\pi$ radians apart such that the dynamic voltage polarity needed for acceleration of each beam bunch is present across each respective gap 38, 40 as a particular beam bunch approaches the gap.

The transverse electromagnetic (TEM) wave modes that are set up in the resonator during operation, can be grouped into two operating modes I and II. In the preferred mode I, the gap voltages oscillate in phase, so as to provide the desired acceleration of a beam bunch at both gaps. In-phase mode I waves couple to the above-described coax transmission line, and may be externally damped using conventional techniques. The second (unwanted) mode II waves correspond to accelerating gap voltages which oscillate 180° out-of-phase with respect to each other, causing a beam bunch which is accelerated in the upstream gap 38, to be decelerated in the downstream gap 40. These mode II waves are not easily coupled out of the resonator because the waves cancel at the center of the resonator, where RF power is applied to the device.

The novel resistor 18 has been added to the center section of drift tube 16 to suppress the mode II waves (whose fundamental and higher order TEM modes all have a current maxima at the center of the drift tube), selectively lowering the resonator Q for these waves, while passing the mode I waves. As shown in FIGS. 2 and 3, resistor 18 comprises two spaced-apart sets of plates 44, 46 mounted about the outside surface of collar 20. Each set 44, 46 consists of a stack of 40 metallic annular plates 50, which are 0.027 inches thick and have inner and outer diameters five inches and eight inches, respectively. Plates 50 are formed of a metal alloy having a high magnetic permeability, herein defined as a relative magnetic permeability greater than 1000. In the preferred embodiment, the plates were formed of a nickel alloy sold by Westinghouse Corporation under the trademark "Hipernom". Spacer rings 54, preferably formed of OFHC copper, provide spacing between plates 50. Spacer rings 54, and plates 50 are compressed together by spring washers not shown in the drawings, located at each end of plate sets 44, 46. Copper shields 60, 62 protect plate sets 44, 46, respectively, from the strong magnetic fields around stems 30, 32 thereby preventing resistor 34 from absorbing desired mode I energy which travels between either stem 30, 32, and the portion of tube 16 immediately adjacent thereto. Shields 60, 62 also prevent applied RF power from entering the respective resistor plate sets. This power is carried along the aforementioned coax transmission line which is bifurcated for connection to points 39 located on shields 60, 62.

When the accelerator is operated, the beam bunches induce out-of-phase mode II waves in the resonator. These waves have a current maxima in the center of the resonator where resistor 18 is located. Mode II waves travel over the outside of shield 60 through the gap 64 between shields 60, 62 and then along the inside surface of shield 60, and thereafter travel over the surfaces of each plate 50. Owing to the frequency of the induced energy and the high permeability construction of the plates 50, the first 1/e thickness or skin depth $\delta$ (a fraction of a mil in dimension), dissipates the Mode II energy. The remainder of the bulk material of each plate is utilized to provide a thermal conductive path to collar 20.

Although various configurations could be employed to provide a properly operating resonant cavity, cavity 10 was designed to meet severe space limitations, namely, a vertical clearance of only 15-3/16 inches. The components within resonator 10, particularly the RF resistor 18, had to be sized accordingly. The resonator 10 is made of OFHC copper and consists of a 12-inch inner diameter outer shell or tank 12, which is 108 inches in length.

The prototype resonator and resistor constructed according to the invention operated at 53 megahertz, with a bandwidth of 7.5 kilohertz, and an unloaded Q of 7050. The resistor according to the invention presented a five ohm load to the 70 ohm accelerator system, and effectively damped the unwanted out-of-phase mode II waves, lowering the resonator Q to 240 for those waves. The coaxial inner drift tube 16 presents a $Z_0$ of 70 ohms to the remainder of the accelerator device. The resistor continuously dissipated in excess of 500 watts, while operating satisfactorily in a hard vacuum ($10^{-9}$ torr). Stems 30, 32 carried 1800 amperes of RF RMS current at 360 KV. With a 30 GPM flow rate of water circulated through resonator 10, no variation in the dissipation characteristics of the resistor was observed. The water was temperature-controlled by an external system.

Figure 5:
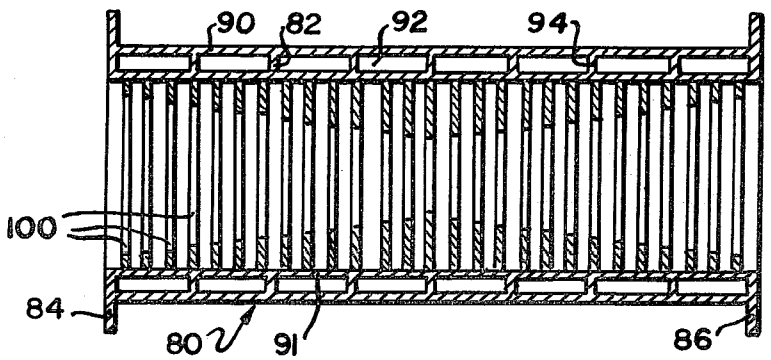
FIG. 5 is a cross-sectional elevational view taken along the lines 5—5 of FIG. 4.
Figure 4:
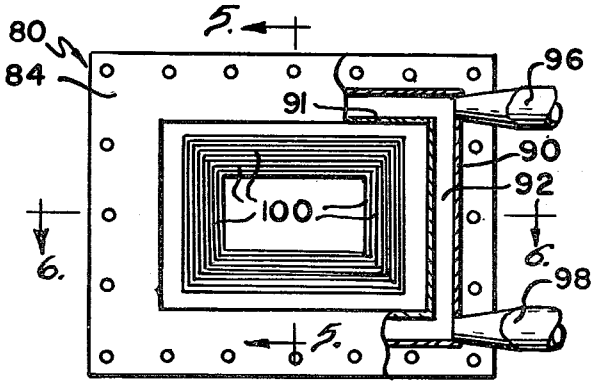
FIG. 4 is an end elevational view of an alternative resistor construction according to the invention.

Having set forth one particular embodiment of the invention, other aspects of the invention will now be described with reference to FIGS. 4–6. A high power radio frequency resistor 80 comprises a rectangular waveguide 82 having mounting flanges 84, 86. An outer envelope wall 90, surrounding the interior wall 91 of waveguide 82, forms a water jacket 92 which surrounds the waveguide. A continuous interior wall 94 forms a helical water path through jacket 92 to provide a circulation of water coolant over interior walls 91.

Inwardly projecting dissipative fins 100, formed of a metal alloy having a relative magnetic permeability of 1000 or more are secured to the inner walls 91 of rectangular waveguide 82. The central opening of fins 100 decreases towards the center of the resistor structure to provide predetermined attenuation. The fins 100 are dimensioned for a given operating frequency and metal alloy composition, to have a thickness several times greater than the skin depth experienced in the fins during operation of the resistor. The remaining material interior to the skin depth of each surface of the fin provides a thermal conductive path for the heat generated in the fin during operation. This heat is conducted to the inner walls 91 of the waveguide, and is thereafter dissipated in the forced cooling provided by water jacket 92. Alternatively, if the power levels dissipated in the resistor are low enough, the water jacket 92 and walls 90, 94 replaced by outwardly projecting fins for air cooling.

The embodiments of the invention in which an exclusive property or privilege is claimed are defined as follows:

1. A radio frequency resistor which attenuates unwanted RF energy of a first resonant mode, while passing desired RF energy of a second resonant mode, comprising:

a central core for conducting radio frequency energy;

first and second sets of spaced-apart plates of metal alloy having a magnetic permeability greater than 1000, disposed about said central core;

said first and second sets of plates spaced apart so as to form a gap therebetween; and first and second conductive shield means disposed about said first and said second sets of plates, respectively, and the gap between said first and said second sets of plates positioned to lie at point along said central core where the unwanted RF energy of said second resonant mode has a current maxima.

2. The device of claim 1 wherein said central core is $\pi$ radians long, said gap is located in the center of said central core, and said desired RF energy is displaced 180° from said unwanted RF energy.

3. The device of claim 1 wherein said plates comprise annular disks of Hipernom alloy.

4. The device of claim 1 further including a resonator cavity disposed about said radio frequency resistor for maintaining the current maxima of said unwanted RF energy in the gap between said first and said second sets of plates.

5. In a charged particle accelerator having a resonator tank disposed in the path of the charged particles, a conductive drift tube disposed within said resonator tank to lie in the path of said charged particles, corona rolls attached to each end of said drift tube to form gaps between said drift tube and said resonator tank, means for energizing said conductive drift tube with wanted RF energy of a first resonant mode such that current maxima of said wanted RF energy are located at said gaps, first and second sets of spaced-apart high magnetic permeability plates disposed about said drift tube central core, said first and said second sets of plates spaced apart so as to form a gap therebetween, first and second conductive shield means disposed about said first and said second sets of plates, respectively, and the gap between said first and said second sets of plates positioned to lie at points along said central core where unwanted RF energy of a second resonant mode has a current maxima.

* * * * *